US006042332A

United States Patent [19]

Kochanowski et al.

[11] Patent Number: 6,042,332

[45] Date of Patent: Mar. 28, 2000

[54] HOUSING PART FOR A PROPELLER PUMP

[75] Inventors: Wolfgang Kochanowski, Windesheim; Ruediger Hamann; Walter Ryborz, both of Halle, all of Germany

[73] Assignee: KSB Aktiengesellschaft, Frankenthal, Germany

[21] Appl. No.: 09/063,789

[22] Filed: Apr. 22, 1998

[30] Foreign Application Priority Data

Apr. 24, 1997 [DE] Germany ..... 197 17 300

[51] Int. Cl.[7] ..... F01D 5/12; F03B 3/12

[52] U.S. Cl. ..... 415/121.1; 415/196

[58] Field of Search ..... 415/196, 197, 415/121.1, 182.1, 185, 189

[56] References Cited

U.S. PATENT DOCUMENTS

| | | | |
|---|---|---|---|
| 1,525,884 | 2/1925 | Plummer | 415/196 X |
| 1,693,352 | 11/1928 | Schmidt | 415/121.1 X |
| 3,650,481 | 3/1972 | Conery et al. . | |
| 3,839,859 | 10/1974 | Woell, Jr. . | |
| 3,957,403 | 5/1976 | Sloan | 415/197 X |
| 4,108,386 | 8/1978 | Conery et al. . | |
| 5,016,825 | 5/1991 | Carpenter | 415/121.1 X |
| 5,163,809 | 11/1992 | Akgun et al. | 415/196 X |

FOREIGN PATENT DOCUMENTS

| | | | |
|---|---|---|---|
| 6929736 U | 7/1969 | Germany . | |
| 1934023 | 1/1971 | Germany . | |
| 151438 | 3/1932 | Switzerland . | |
| 1189469 | 4/1970 | United Kingdom | 415/197 |

*Primary Examiner*—John E. Ryznic
*Attorney, Agent, or Firm*—Evenson, McKeown, Edwards & Lenahan, P.L.L.C.

[57] ABSTRACT

A housing for surrounding the impeller of a propeller pump, the housing having a gap ring disposed in a housing bore in the interior thereof, the gap ring being open at its circumference and in the uninstalled state having an outside diameter which is greater than the diameter of the bore which receives it, while in the installed state being pressed with bias against the housing bore which accommodates it due to the reduction of the ring's diameter. The gap ring of the invention which is open at its circumference advantageously reduces the cost of manufacture and assembly of gap rings for propeller pumps.

3 Claims, 2 Drawing Sheets

HOUSING PART FOR A PROPELLER PUMP

BACKGROUND OF THE INVENTION

The invention relates to a housing enclosing the impeller of a propeller pump, having a gap ring disposed within the housing.

The split ring disposed in the housing or a housing part of a propeller pump serves to lessen the wear produced on the outside diameter of the propeller by gap cavitation. Furthermore, such gap rings are used wherever dirty liquids with high material ablation rates must be dealt with. Thus, the gap rings composed of a cavitation- and wear-resistant material serve to increase the useful life of the pump housing. This is utilized chiefly in constantly running propeller pumps and with aggressive liquids and liquid which carry a large percentage of dirt.

The gap ring, which heretofore has been in the form of a continuous, annular piece, serves to counteract any enlargement of the radial gap between the propeller and the surrounding pump housing and the reduction of the pump output caused thereby. In the case of liquids containing fibrous components, a stripping or cutting edge is disposed on the gap ring to prevent clogging. For this purpose a longitudinal slot is disposed on the inside of the gap ring, which incidentally makes it necessary to increase the wall thickness. The cost producing a gap ring of the kind described is relatively high, since its outside diameter has to be precisely matched to the housing in which it is contained.

SUMMARY OF THE INVENTION

It is the object of the invention to considerably reduce the cost of producing a gap ring and of installing it in a housing.

In accordance with the invention, this and other objects are achieved by providing a gap ring that is open at its circumference, and which in the uninstalled state has a greater outside diameter than the housing bore in which receives it, such that the gap ring in the installed state is pressed or biased against the housing bore by the reduction of its diameter.

In one advantageous embodiment of the invention, the circumference of the gap ring is such that, after the gap ring is inserted into the housing bore, an axial groove is formed at its open point, one of the faces adjoining the groove forming a stripping or cutting edge for fibrous matter contained in the liquid being pumped.

The circumstance that the gap ring, when in the installed state, is urged with bias against the housing bore due to the reduction of its diameter serves in an expedient embodiment of the invention to hold the gap ring in position solely by the friction produced by its bias.

In order also to be secure against rotation if coarse and hard substances become held between the propeller and the gap ring, the gap ring can be anchored in the housing with one or more pins.

The gap ring according to the invention can be made with thinner walls than the continuous gap rings of the prior art, since it does not have to be pressed into the housing and thus its stability of shape does not have to satisfy such stringent requirements. This is especially the case when a stripping or cutting edge must additionally be formed, since this function is served by the end face at the opening in the gap ring. Manufacturing and fitting problems are minimized. Due to the open configuration of the gap ring, it is also easier to replace, which is very fortunate especially where great wear might be involved.

BRIEF DESCRIPTION OF THE DRAWINGS

The invention will be explained in further detail hereinafter with reference to an illustrative preferred embodiment shown in the accompanying drawings in which.

DETAILED DESCRIPTION OF PREFERRED EMBODIMENTS

Figure 1:
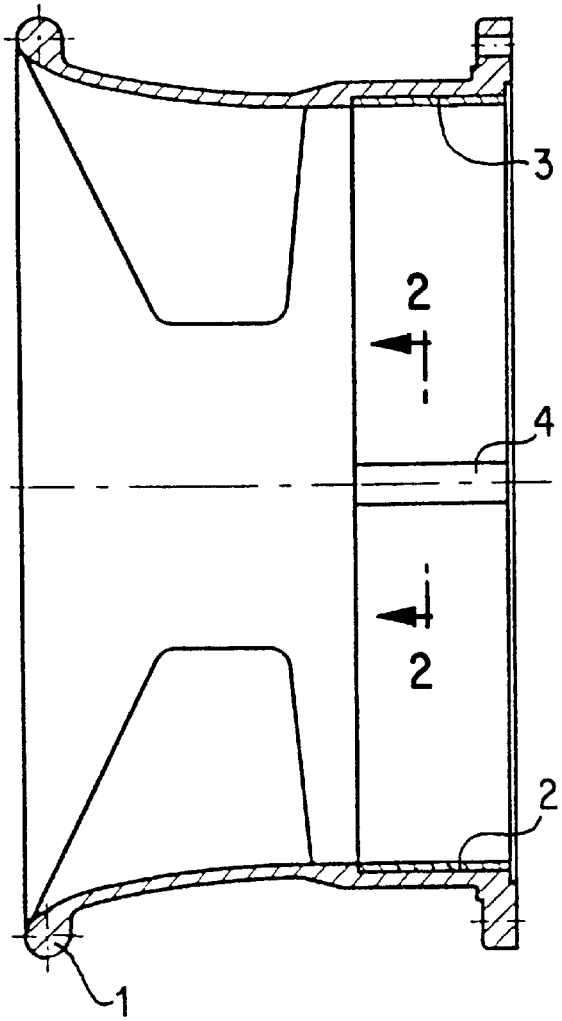
FIG. 1 shows a central section through a pump housing part having a gap ring according to the invention inserted therein.

FIG. 1 shows the suction nozzle 1 of a pump housing with a divided gap ring 2 disposed therein. The gap ring 2, which in the uninstalled state has a greater outside diameter than the housing bore 3 of the suction nozzle 1, is set in the bore 3 after being compressed together. The bias produced by the reduction of its diameter causes the gap ring 2 to press against the bore 3. In many cases this pressure is sufficient to secure the gap ring 2 against rotation and hold it by friction in its position. In the case of greater stress, which can be caused for example by coarse or hard clogging substances in the liquid being pumped, additional fastening may be provided by one or more pins 6 anchored in the suction nozzle 1.

Figure 2:
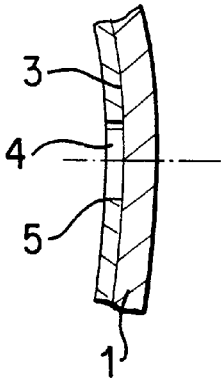
FIG. 2 shows a detail view corresponding to the section A—A of the pump housing part of FIG. 1.
Figure 3:
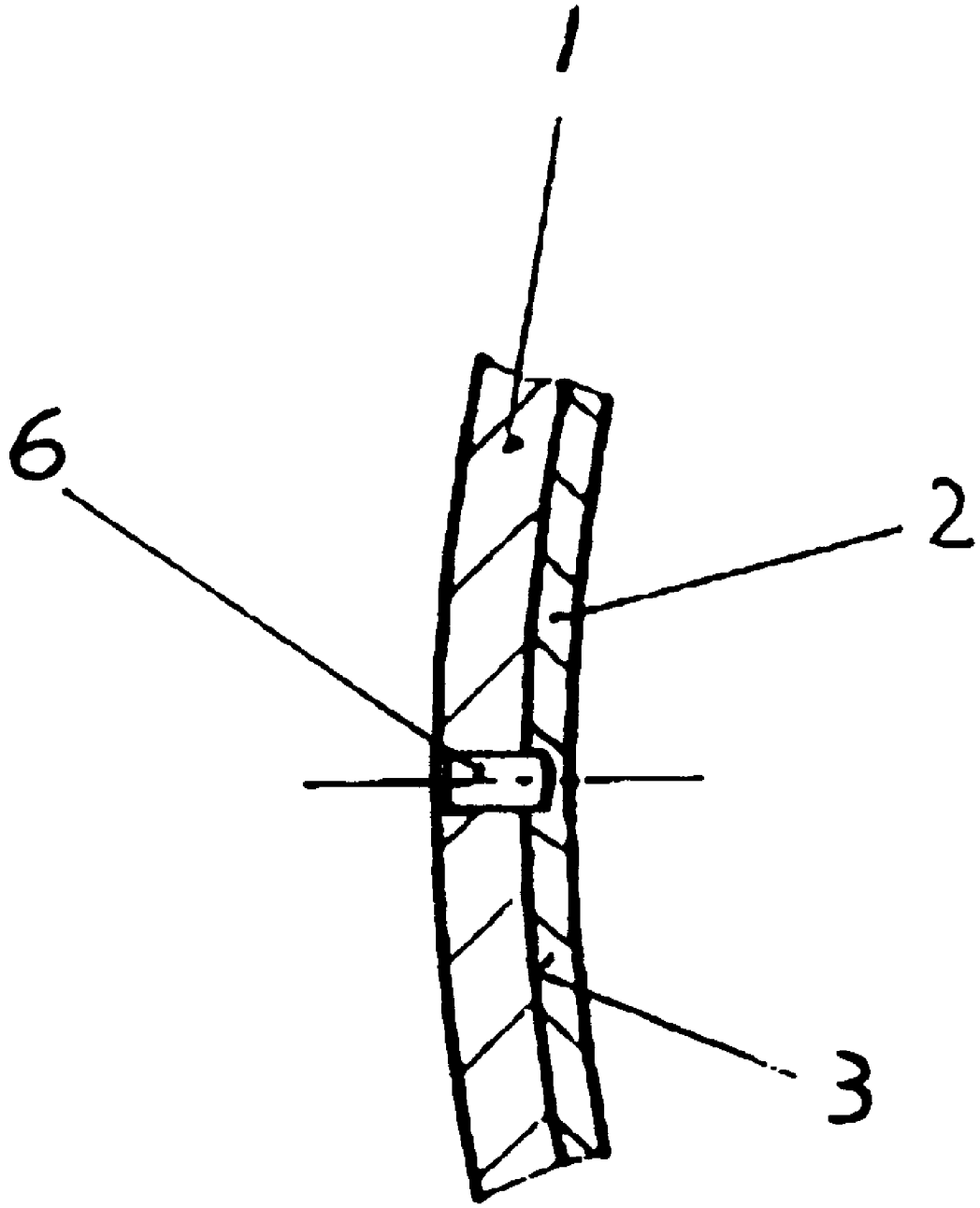
FIG. 3 is a detail view similar to FIG. 2 showing a pin fastening the gap ring in the suction nozzle.

The gap ring 2 inserted into the inlet nozzle 1 forms a groove 4. As can be seen in the section A—A shown in, FIG. 2, a stripping edge 5 is formed at the face of the groove 4 pointing against the running propeller (not shown here). Fibrous matter contained in the liquid being pumped, which adheres to the propeller or impeller of the pump, is caught by the stripping edge 5 and then carried along by the flow. But in cooperation with the spinning impeller the stripping edge 5 can also have a cutting action on the components contained in the liquid.

The foregoing description and examples have been set forth merely to illustrate the invention and are not intended to be limiting. Since modifications of the described embodiments incorporating the spirit and substance of the invention may occur to persons skilled in the art, the scope of the invention should be broadly construed to include all variations within the scope of the appended claims and equivalents thereof.

What is claimed is:

1. In combination, a housing for surrounding an impeller of a propeller pump, and a gap ring disposed in a bore in the interior of said housing, said gap ring being constructed with an opening in its circumference and in the uninstalled state having a diameter greater than that of the bore in which it is received, said gap ring in the installed state being pressed with bias against said housing bore due to reduction of the ring's diameter, wherein the gap ring has a circumference dimensioned such that when the gap ring is inserted into the housing bore, an axial groove is formed at the opening in the gap ring, said gap ring having a face adjoining said groove which forms a stripping or cutting edge for fibrous materials present in a liquid pumped by the propeller pump.

2. A housing and gap ring combination according to claim 1, wherein the gap ring is held in position only by friction developed between the gap ring and the housing bore due to the bias generated upon insertion of the ring into the housing bore.

3. A housing and gap ring combination according to claim 2, further comprising at least one anchoring pin for securing the gap ring against rotation relative to the housing.

* * * * *